US005960966A

United States Patent [19]

Riga et al.

[11] Patent Number: 5,960,966

[45] Date of Patent: Oct. 5, 1999

[54] MODULAR WALLS FOR DEATH CARE MERCHANDISE DISPLAY UNIT

[75] Inventors: Dennis J. Riga, New Albany; Douglas E. Kellogg, Canal Westchester, both of Ohio

[73] Assignee: The York Group, Inc., Houston, Tex.

[21] Appl. No.: 08/853,343

[22] Filed: May 8, 1997

Related U.S. Application Data

[63] Continuation-in-part of application No. 08/788,324, Jan. 24, 1997.

[51] Int. Cl.[6] ..... A47F 7/00

[52] U.S. Cl. ..... 211/85.16

[58] Field of Search ..... 211/85.16, 27, 211/162; 27/1, 27; 52/128, 134, 129

[56] References Cited

U.S. PATENT DOCUMENTS

| | | | |
|---|---|---|---|
| D. 48,928 | 4/1916 | Clark . | |
| D. 218,890 | 10/1970 | Kreminski | D19/1 |
| D. 350,246 | 9/1994 | Louise et al. | D6/479 |
| D. 351,076 | 10/1994 | Eliadis et al. | D6/476 |
| D. 354,825 | 1/1995 | Parker | D99/8 |
| D. 381,693 | 7/1997 | Thompson | D20/10 |
| 518,335 | 4/1894 | Sherman . | |
| 1,134,719 | 4/1915 | Benzing . | |
| 1,821,760 | 9/1931 | Leitch et al. . | |
| 1,912,790 | 6/1933 | Payne . | |
| 1,966,751 | 7/1934 | Brefeld . | |
| 3,190,243 | 6/1965 | Pira | 108/152 |
| 3,504,409 | 4/1970 | Keller, Jr. | 27/6 |
| 3,567,039 | 3/1971 | Evans . | |
| 3,585,944 | 6/1971 | Schoer | 108/111 |
| 3,676,905 | 7/1972 | Mack | 27/6 |
| 4,891,897 | 1/1990 | Gieske et al. | 40/618 |
| 4,998,388 | 3/1991 | Englehart | 52/36 |
| 5,370,249 | 12/1994 | Harvey et al. | 211/189 |
| 5,405,017 | 4/1995 | Szabo, Sr. et al. . | |
| 5,495,954 | 3/1996 | Schmit | 211/90 |
| 5,586,376 | 12/1996 | Enneking et al. . | |
| 5,622,010 | 4/1997 | Weber | 52/36.4 |

OTHER PUBLICATIONS

Quarter coffin designs practiced in France (photos attached).

*Primary Examiner*—Alvin Chin-Shue
*Assistant Examiner*—Sarah Purol
*Attorney, Agent, or Firm*—Locke, Liddell & Sapp LLP

[57] ABSTRACT

A death care merchandise display unit comprises two vertical, parallel, spaced wing wall panels, a vertical back wall means having lateral edges secured to the rear edges of the wing wall panels and optionally at least one decedent confinement chamber positioned between the two vertical spaced wing wall panels with a drawer slide means for rolling the chamber outward or a cornice display structure projecting from the vertical back wall of the merchandise display area or securement means for affixing death care merchandise selected from coffins, caskets, vaults, urns, sectionals or miniatures thereof and materials for decorating the same onto the merchandise display area. The securement means may consist of drawers adjacent to the decedent confinement chamber for exhibiting casket adornment materials. The cornice display structure may consist of two vertical panels and a horizontal beam secured to the vertical panels, the horizontal beam extending at least fifty percent of the distance defined by the vertical back wall. In addition, the cornice display structure may contain an illumination means affixed onto its inner perimeter. The display system may include multiple components used together, and may include modular wall panels for providing a uniform wall panel and backdrop which matches or contrasts with the components of the display system, and for separating adjacent spaces used for various death care-related purposes. The modular wall panels may further define a passageway between the adjacent spaces.

48 Claims, 10 Drawing Sheets

*Fig. 5*

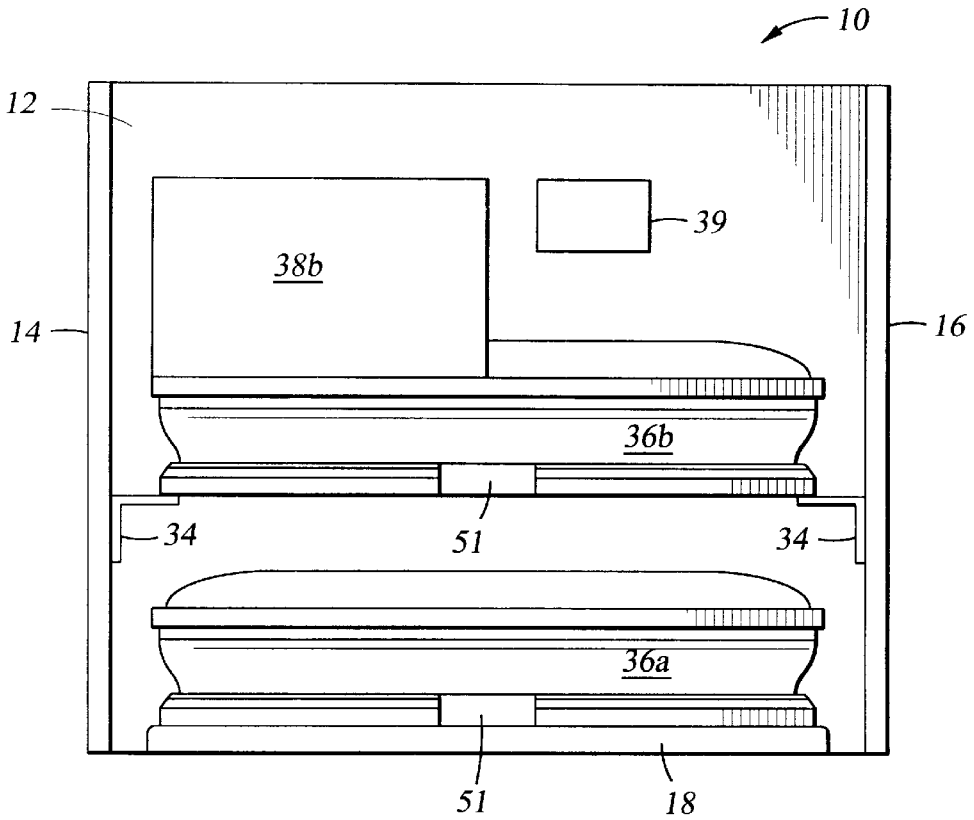
Fig. 1
Fig. 2
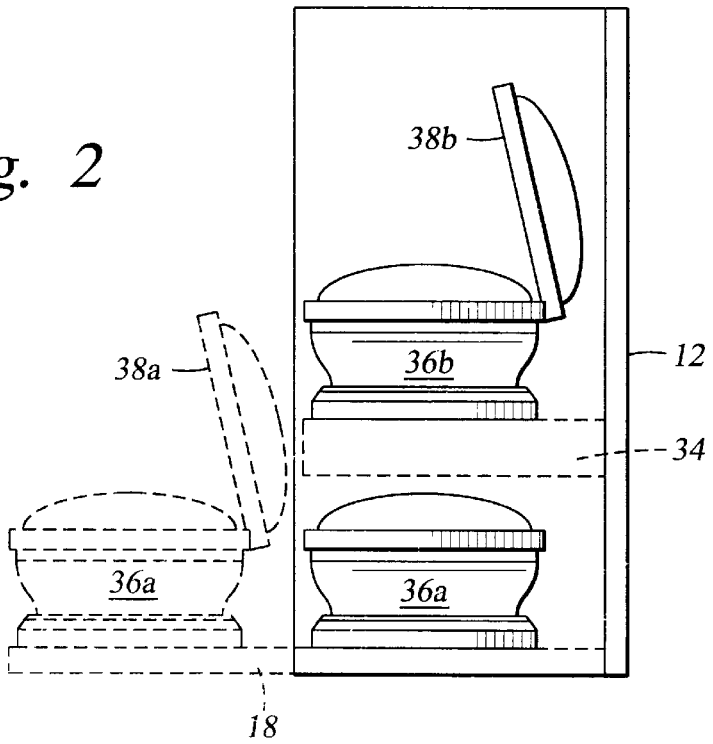

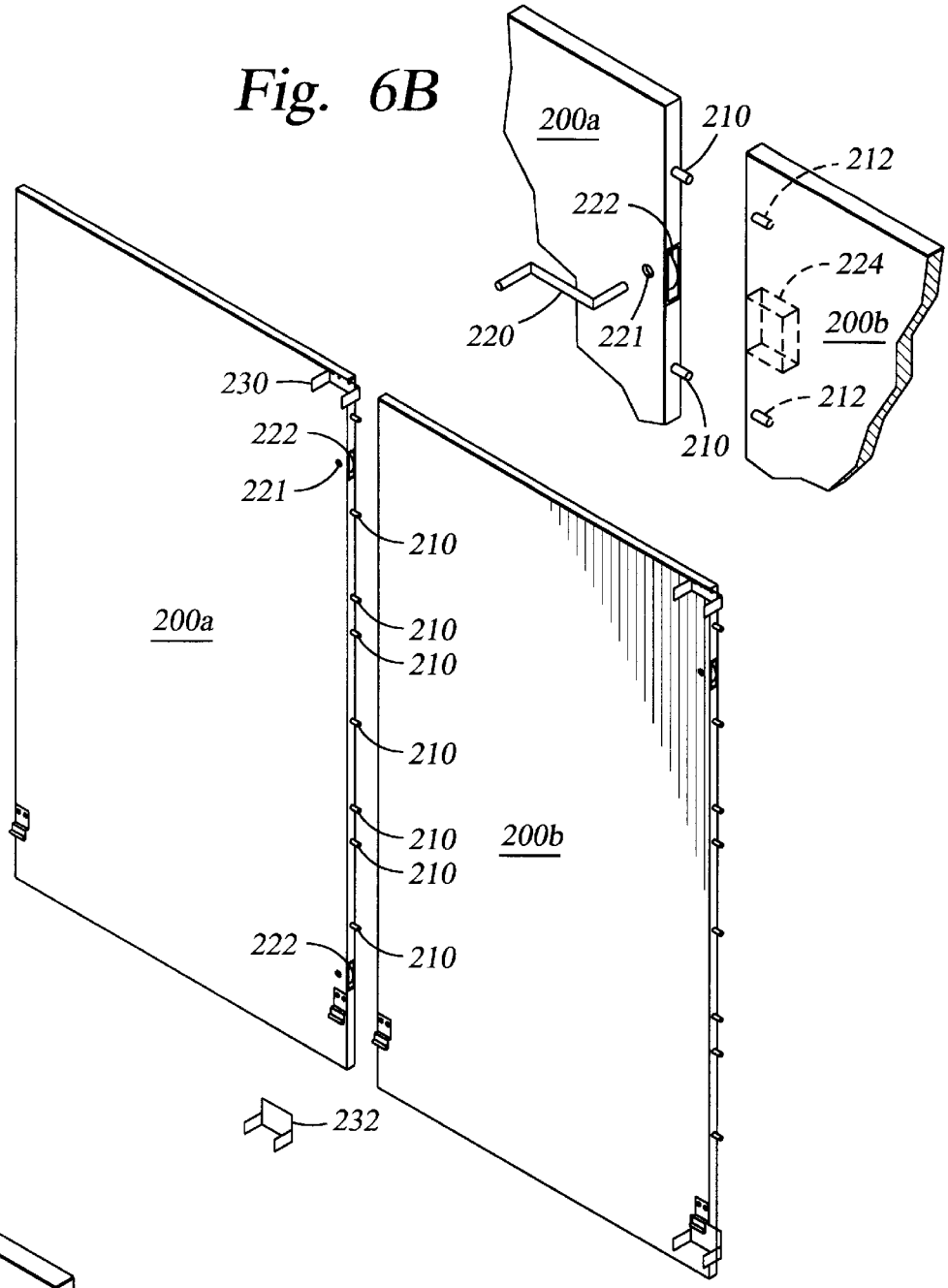
Fig. 6B
Fig. 6
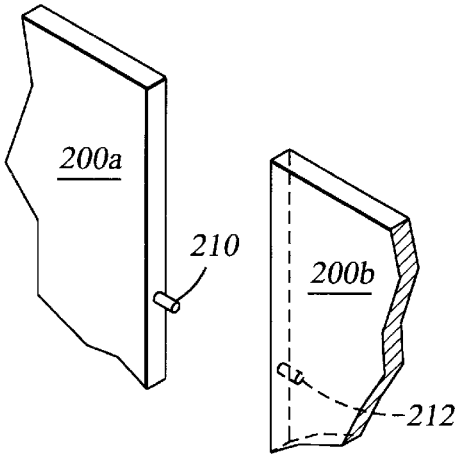
Fig. 6A

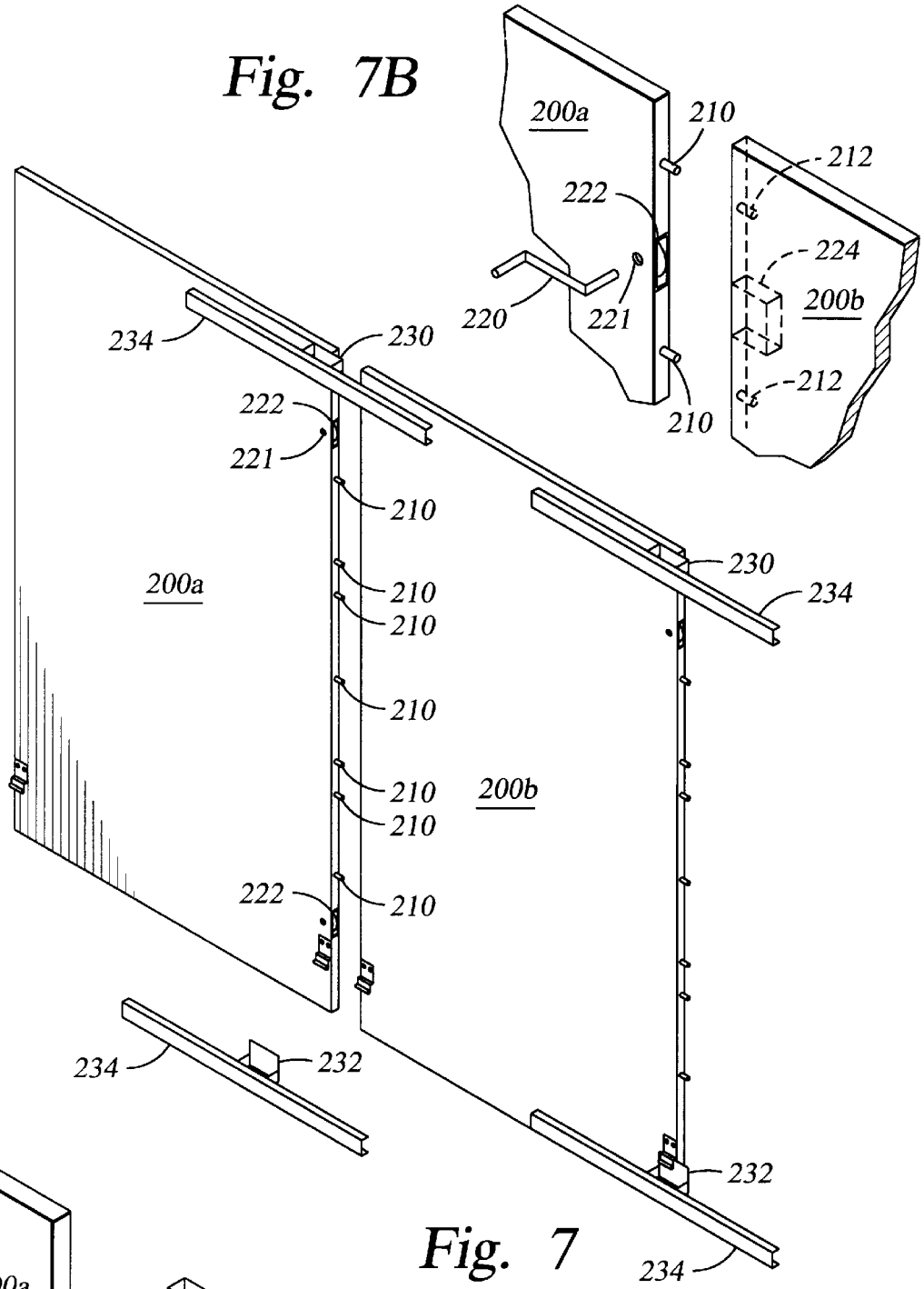
Fig. 7B
Fig. 7
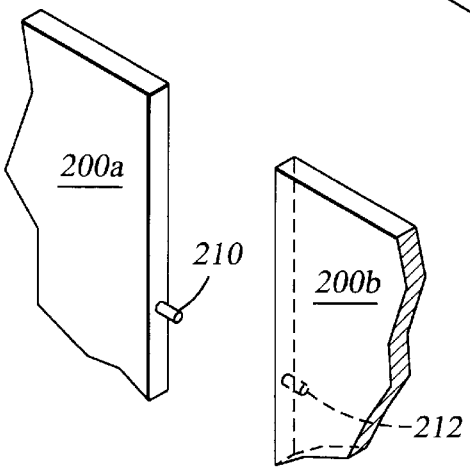
Fig. 7A

MODULAR WALLS FOR DEATH CARE MERCHANDISE DISPLAY UNIT

RELATED APPLICATIONS

This application is a Continuation-in-Part of our prior co-pending U.S. patent application Ser. No. 08/788,324 filed on Jan. 24, 1997.

STATEMENT OF FEDERALLY FUNDED RESEARCH

Not applicable.

BACKGROUND OF THE INVENTION

The present invention relates to an integrated display system for death care merchandise such as caskets, coffins, urns, burial vaults and materials for decorating or adorning the same. The display systems of the invention are particularly designed for use by prospective purchasers in a preview room. The display system may include multiple components used together, and may include modular wall panels for providing a uniform wall panel and backdrop which matches or contrasts with the components of the display system, and for separating adjacent spaces used for various death care-related purposes. In addition, the display system may be useful for displaying death care merchandise during its intended use, such as in a memorial or funeral service as well as viewing room.

Various casket display systems are known in the art. The more primitive of such systems consist of a casket display rack or support. See, for instance, U.S. Pat. No. 2,937,768 which discloses a two-tiered casket display rack having a rigid C-shaped frame-like structure for the display of two caskets—one casket supported above another.

U.S. Pat. No. 5,405,017 discloses a more contemporary casket display system for full caskets. The display system of the '017 patent includes a two-tiered casket display rack retractable by means of a scissors unit which, in turn, is connected to a rod. The display rack of the '017 patent is not an integral part of the casket display system.

While the casket display system of the '017 patent offers a more serene setting than the primitive systems of the prior art, as set forth in the '768 patent, they do not permit the full display of merchandise used in the funeral and death care industry. In addition, it does not permit the display of all types of merchandise such as adornment accessories, urns and burial vaults.

Further, the display systems of the prior art containing a rollout rack onto which a full casket is mounted basically require the presence of two caskets—one on a top shelf and the second on a bottom shelf. Such systems are difficult to manage and handle especially since the lower casket is often required to be in a retracted state.

The need exists therefore for a display system which permits the exhibition of a greater volume and a greater type of death related merchandise at greater ease for the prospective purchaser. In addition, the need exists for a display system which can be more easily assembled and utilized than afforded by the systems of the prior art.

SUMMARY OF THE INVENTION

A death care merchandise display unit which maximizes the types and styles of death care merchandise comprises two vertical, parallel, spaced wing wall panels and a vertical back wall having lateral edges secured to the rear edges of the wing wall panels. The display unit may contain a retractable rack connected to the two vertical spaced wing wall panels having a slide mechanism. The slide mechanism is preferably one having one of its members attached to the inside of the wing wall panel and another member attached to the retractable rack. The retractable rack typically is employed for displaying a burial vault, coffin or casket.

Yet another embodiment of the invention is directed to a modular death care merchandise display unit having means for interconnecting two or more modular unit.

Yet another embodiment of the invention is directed to a plurality of modular death care merchandise display units having means for interconnecting the individual units by modularwall panels. The modularwall panels provide a uniform wall panel and backdrop which matches or contrasts with the components of the display units. The modular wall panels may also be used as free standing walls, together with or separate from the display units. The modular wall panels thus may be used for separating adjacent spaces associated with various death care-related purposes, such as display of burial-related merchandise, cremation-related merchandise, and memorial paraphernalia and merchandise.

BRIEF DESCRIPTION OF THE DRAWINGS

FIG. 1 is a frontal view of one embodiment of the display unit of the invention.

FIG. 2 is a side view of the display unit of FIG. 1 illustrating the retractability of the bottom rack.

FIG. 6 is a rear angled view of a pair of modular wall panels in accordance with the invention. FIGS. 6A and 6B are closeup details of FIG. 6.

FIG. 7 is a rear angled view of an alternative embodiment of a pair of modular wall panels in accordance with the invention. FIGS. 7A and 7B are closeup details of FIG. 7.

DETAILED DESCRIPTION OF PREFERRED EMBODIMENT

Figure 3:
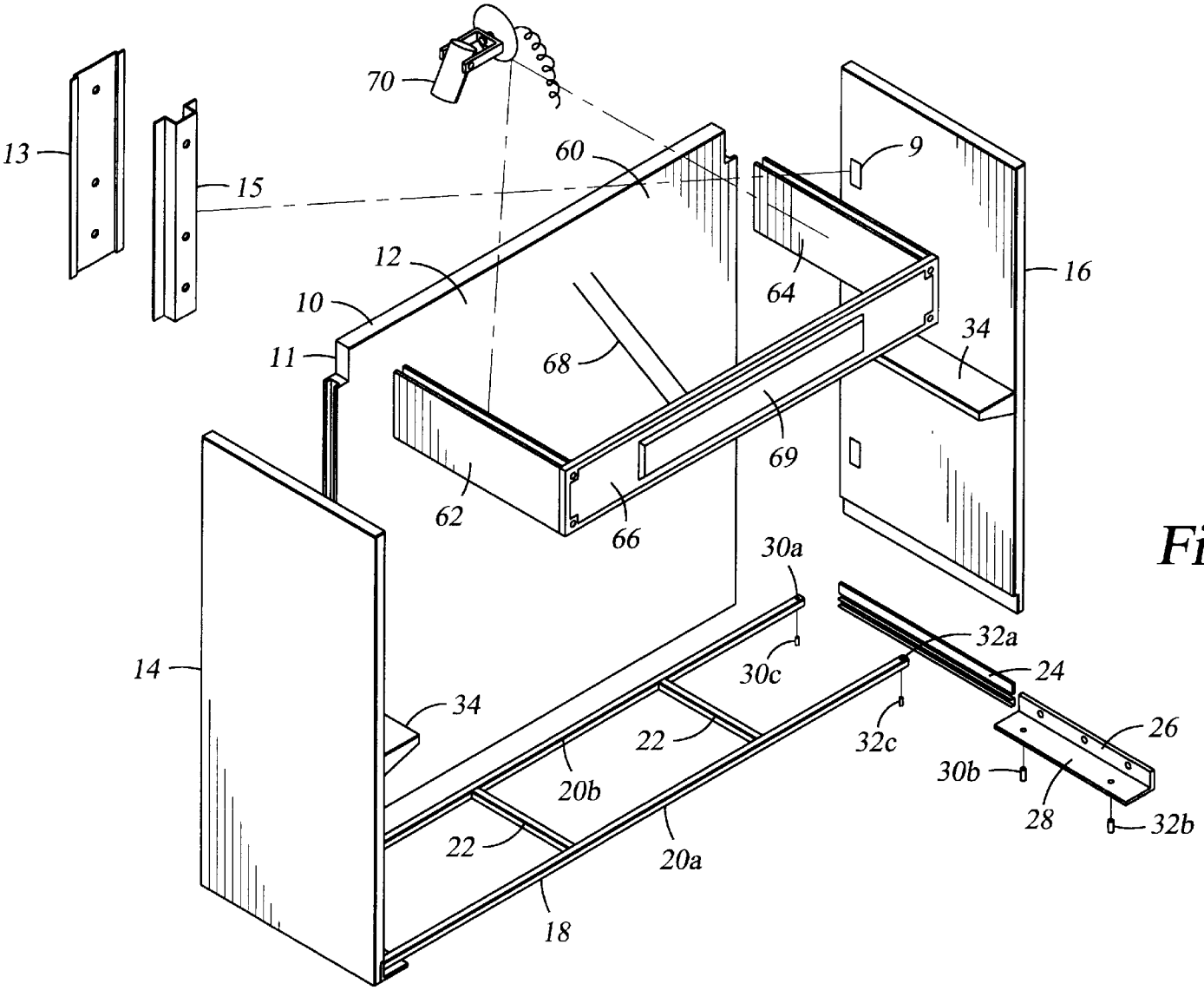
FIG. 3 is a frontal angled side view of a display unit of the invention.

The present invention provides an integrated display system for death care related merchandise. The display system of the invention is principally used in a preview room where selection of death care related merchandise by the decedent's loved ones occurs. In addition, the display system of the invention may be used in death related ceremonial areas such as the viewing room of a funeral home as well as at funeral and memorial services.

The display system of the invention is defined by a back wall and side or wing walls, and may include one or more attached or freestanding modular wall panels. One of the principal advantages of the display system of the present invention is that it maximizes the number and types of death care merchandise which may be displayed in a given area, and allows additional uses to be made with the additional space which results therefrom.

When the display system of the present invention is utilized in conventional death care facilities, the efficiency with which the available space is used is greatly increased. Thus, where a facility of, e.g., 1000 square feet was previously required, by employing the present invention the space required to display the same quantity of death care merchandise may be reduced to 500 square feet or less. The benefit obtained from using the display system of the present invention may be realized by adding modular wall panels of various styles and in various configurations. Use of the modular wall panels enables creative use of the newly available space for adding new spaces or whole rooms useful for many death care-related purposes.

The display system of the invention may further be a modular assembly, permitting it to be assembled and disassembled within a short period of time as well as on an "as needed" basis. The ability of the display system to be modular permits purchasers to buy all or sections of the system when so desired.

The display system contains a number of novel features which may be used alone or in combination with each other. FIGS. 1 and 2 show an embodiment of the death care merchandise display system 10 of the invention, principally for use in preview rooms. The display system 10 comprises a back wall 12 and two side or wing walls 14 and 16. Wing walls 14 and 16 are connected with back wall 12 at the rear section of the wing wall. The vertical back wall 12 may be removably secured to the rear edges of wing walls 14 and 16.

As set forth in FIGS. 6–11, a modular wall panel 200 may be attached to at least one death care merchandise display system 10, or a plurality of the modular wall panels 200 may be freestanding, adjacent or associated with a display system 10, and may be used to form separate smaller chambers or rooms from a larger chamber or room, and may include a pocket modular door panel having a door which may be used to provide a passageway between the separate rooms.

Figure 8:
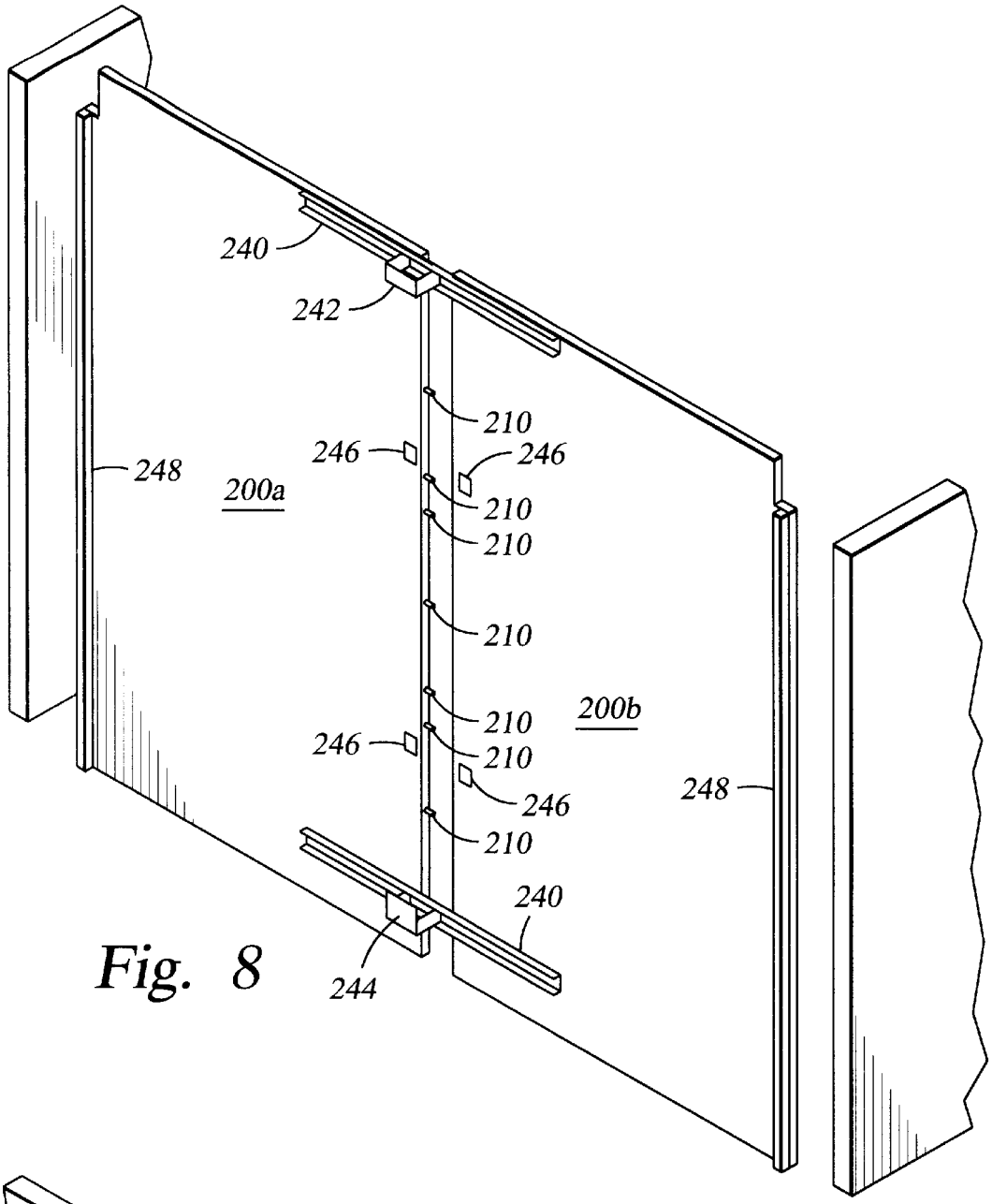
FIG. 8 is a rear angled view of another embodiment of a pair of modular wall panels in accordance with the invention, including an attachment to adjacent perpendicularly mounted wall panels.

The modular wall panels are attached to the display system 10 or to other modular wall panels by conventional means. The conventional means include devices such as dowel pins for aligning the modular wall panels, and docking mechanisms such as a cam locking device for securely but releasably attaching together the modular wall panels. The most preferred attachment and alignment devices are shown in FIGS. 6, 7 and 8.

Figure 8A:
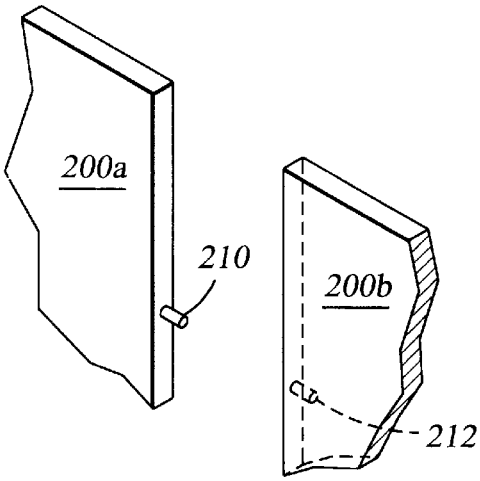
FIG. 8A is a closeup detail of FIG. 8.

As best shown in FIGS. 6A, 7A and 8A, conventional dowel pins 210 are inserted and preferably affixed into holes in the edge of the modular wall panel 200*a*. Matching receiving openings 212 are located on the edge of adjacent modular wall panel 200*b*, as best shown in FIG. 8. For each dowel pin 210 there is a matching receiving opening 212 for receiving the dowel pin 210. This connection assures a uniform alignment of the adjacent modular wall panels 200*a* and 200*b*.

As shown in FIGS. 6B and 7B, the adjacent modular wall panels 200*a* and 200*b* are preferably secured together by a cam lock device. The cam lock device includes an actuating handle 220, cam locking member 222, and cam locking receiving member 224. In use, the actuating handle 220, which is a separate piece removable from the modular wall panel, is inserted into an opening 221 in the back wall of the modular wall panel 200*a*. The opening 221 is aligned with the cam locking member 222, so as to allow the handle 220 to actuate the cam locking member 222.

The foregoing cam locking device and dowel aligning devices are conventional, and equivalent devices may be substituted therefor without departing from the scope of the present invention.

Figure 12:
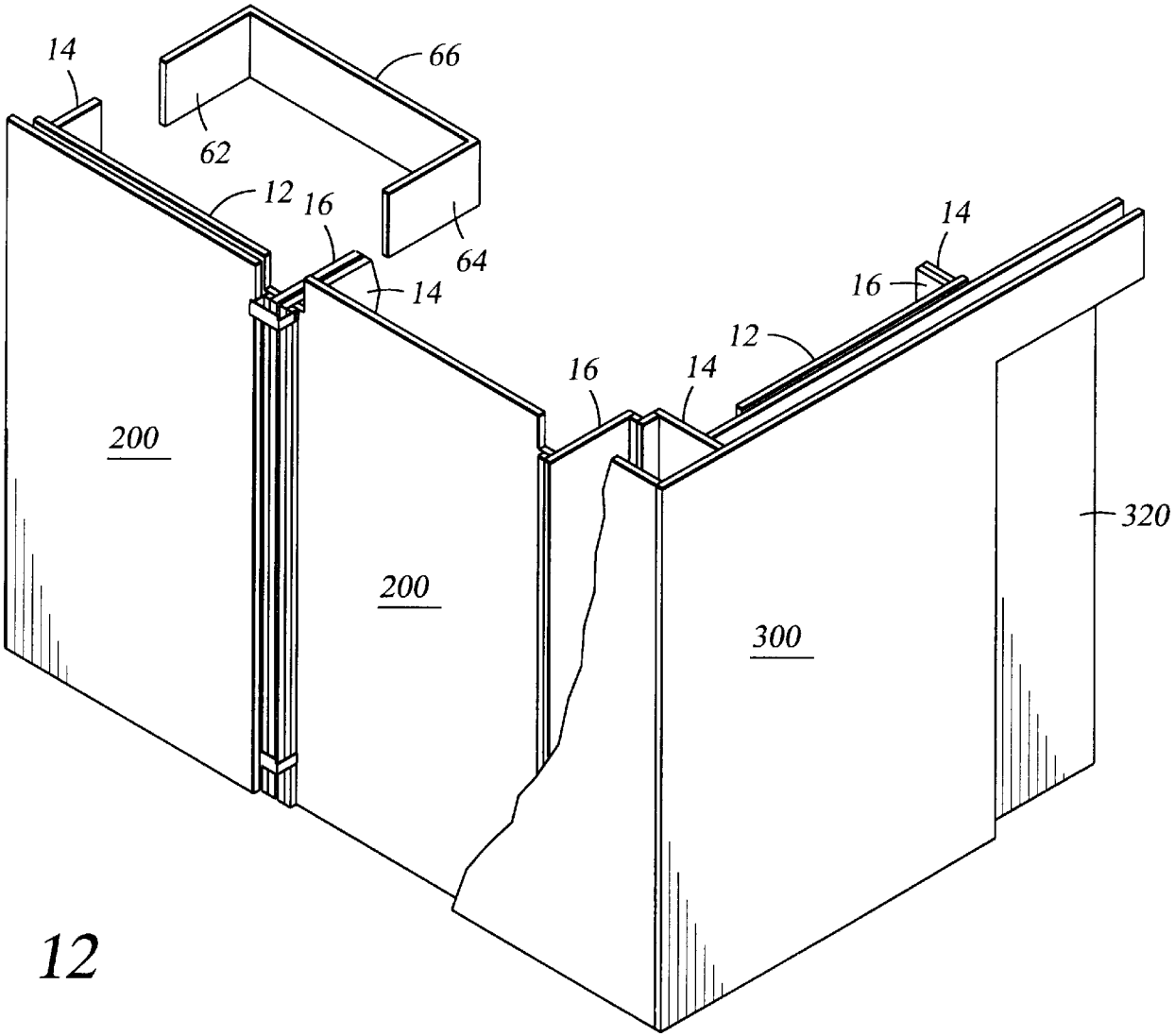
FIG. 12 is an angled rear view of a display system, including portions of a display unit and a pocket modular door panel and pocket door, in accordance with the present invention.

Preferably, as shown in FIG. 12, the modular wall panel 200, when used with a display unit 10, is attached to the back wall 12. The wing walls 14 and 16 may be used with the combined back wall 12 and modular wall panel 200. In an embodiment including the wing walls 14 and 16, the display system includes separate units or alcoves interconnected by modular wall panels 200.

As set forth in FIG. 3, wing wall panels 14 and 16 are attached to back wall panel 12 by conventional ready-to-assemble ("RTA") fittings in the art. Depicted are fitting 13 with flanges which mate with fitting 15 having an approximate ½" deep recessed area. Back wall panel 12 has an L-shaped cut 11 and wing wall panels 14 and 16 have receptor notch 9 for the RTA fittings.

The back, wing wall panels and modular wall panels of the display system of the invention are typically plywood but may be fiberwood or other durable material such as a synthetic plastic material as plexiglass or Mylar. The back, wing wall(s) or modular wall(s) may be covered with a fabric-like material or have a textured surface. When so desired, the fabric-like material may be removably attached to the panel allowing the user to select the color and texture.

Back wall panel 12, wing wall panels 14 and 16, and modular wall panels 200 may include known means for removably attaching objects such as signs and photographs. The means for attaching objects include, e.g., peg-board type attachments, slat wall, tackable surfaces, hook-and-loop fabric (e.g., VELCRO®) attachments, magnetic attachments or other known devices for removably attaching objects to a vertical surface for display of the objects.

The alcove defined by back wall panel 12, left wing wall panel 14 and right wing wall panel 16 may display one or more decedent confinement chambers 36. The decedent confinement chambers may be actual size, sectionals of actual size or miniatures. The alcove may contain stationary or retractable chambers or a combination thereof.

FIG. 1 illustrates an alcove having two actual size decedent confinement chambers. The lower chamber, 36*a*, rests on display rack 18. The upper non-retractable chamber, 36*b*, rests on shelving brackets 34, which are secured to wing wall panels 14 and 16.

The display unit 10 may further contain identification placards 51 in front of decedent confinement chambers 36*a* and 36*b*. In preview rooms, placards 51 are used to inform the customer of features of the displayed casket. Signage 39 or other communicative materials may further be mounted on back wall 12 or wing walls 14 or 16 to designate information about the death related merchandise (when used in a showroom display setting) or the decedent (when used in a viewing room, funeral home or memorial service setting). When used in a preview room display setting, each of decedent confinement chambers 36*a* and 36*b* may be displayed with signage or other communicative means providing information to the prospective purchaser of the chamber. Signage 39 may be used in lieu of or in addition to placards 51. Such signage may be mounted on and used in a similar manner on the modular wall panels 200. The wing and wall panels, illustrated in FIGS. 1 and 2 are typically 5 to 8 feet, preferably 7 feet, tall. The length of back wall 12 is sufficient to contain an actual size decedent confinement chamber. The modular wall panels 200, illustrated in FIGS. 6–12 are typically 5 to 8 feet, and preferably 7 feet, tall, selected so as to present an upper edge flush with the upper edge of the wing and wall panels. Of course, the back wall, wing wall and modular wall panels may extend to the ceiling of the room in which they are used, or to any height above the preferred range. The modular wall panels 200 are preferably 48 to 60 inches wide, are preferably about 50 inches wide, and most preferably are 50¼ inches wide.

Rack 18 is preferably extendable from back wall panel 12. FIG. 2 illustrates a side view of FIG. 1 before and after the extension of rack 18 from the back wall panel. When fully extended, the interior of both decedent confinement chambers 36*a* and 36*b* may be viewed. Lid 38*b* may be fully raised. In addition, when rack 18 is in a retracted state, lid 36*a* of decedent confinement chamber 36*a* may be fully raised without abutting other elements of the display unit.

Retractable rack 18, when present, is an integral part of death care merchandise display system 10. As set forth in FIG. 3, rack 18 may consist of horizontal beam 20. Typically, two horizontal beams—shown as 20*a* and 20*b*—are employed to more evenly distribute the weight of the decedent confinement chamber. Vertical beam 22 connects the horizontal beams 20*a* and 20*b* and provides additional support to the rack. One or more vertical beams may be used. The rack is typically metallic, such as steel or aluminum, and is of a construction capable of holding the weight exerted on it by the decedent confinement chamber.

The means for rolling rack 18 outwards for better view may be any slide assembly mechanism conventionally used for heavy-duty drawers, such as side mounted draw guide assemblies used in the manufacture of office furniture. As set forth in FIG. 3, such slide mechanisms may be characterized by a hollow U-shaped guide rail 24 fastened to the interior of each of the wing walls of the display unit and an extendible runner rail 26 which, when the rack is not retracted, is encased within the U-shaped guide rail 24. Runner rail 26 further consists of bottom plate 28 which is mounted to the ends of horizontal beam 20*a* at 30*a* with 30*b* by screw fastener 30*c*. Where two horizontal beams are employed, runner rail 26 contains additional mating end 32*b* for mounting to the horizontal beam at 32*a* with screw 32*c*. Where desired, the slide mechanism may further contain rolling bodies on the runner rail for engaging with the races in the guide rail.

Further, either the guide rail or the runner rail is preferably provided with a stopper that prevent the rack from being rolled out too far while allowing it to be pulled out far enough for the lid to be free of impediments.

As used herein, the term "decedent confinement chamber" shall refer to a casket, coffin or burial vault and, where appropriate, urns. The term shall include ready-for-use caskets, coffins and burial vaults as well as the facade of caskets, coffins and burial vaults. Where the display unit is to be used in a preview room and designed not to be opened, it is especially preferred to use facades of such caskets, coffins and burial vaults. The facade typically includes those outer sides and surfaces of the chamber visible to the observer. Where the chamber is being used to exhibit only the facade, the inner chamber is hollow.

The retractable rack illustrated in FIG. 3 may be used with caskets or coffins as well as burial vaults. The decedent confinement chamber may either be the facade of such chambers or a ready-for-use chamber. The facade of chamber 36*a* and 36*b* of FIG. 2 would include the top, front and sides of the chamber.

The display unit of the invention may contain more than one retractable decedent confinement chamber. When two retractable racks are so desired, a solid support (such as plywood or metal sheet) may rest on shelving brackets 34 to give the upper retractable rack the requisite support. Alternatively, shelling brackets 34 may be substituted with a solid support surface extending from (and secured to) left wing wall 14 to right wall panel 16. A drawer slide assembly unit similar to that illustrated in FIG. 3 would be used for both of the retractable decedent confinement chambers.

It is often desirable, especially where the display unit contains a retractable decedent containment chamber, to secure the unit to a stationary support. Thus, the back wall 12 may be secured to the adjoining wall (or sheetrock) surface of the building. Alternatively, or in addition to securing the back wall to the adjoining wall, the base of the wing wall or back wall may be bolted, by means of conventional fasteners, to the floor. By doing so, the potential torque on the display due to the extendible decedent confinement chamber will be counteracted.

The modular wall panel 200 may be secured to a stationary support, such as an adjoining wall (or sheetrock) surface of the building. Alternatively, or in addition to securing the modular wall panel 200 to the adjoining wall or to adjacent display units, the base of the modular wall panel may be attached, by means of conventional fasteners, to the floor. By doing so, the modular wall panels will be stabilized.

The modular wall panel 200 may be mounted in a freestanding mode. A plurality of the modular wall panels 200, mounted as a freestanding group, may be used to form smaller rooms or spaces within the confines of a larger room.

As set forth in FIGS. 6–9, the modular wall panels 200 may include devices for mounting the panels 200 to an adjacent wall or other building structure (not shown). Such devices may include, e.g., upper panel mounted bracket 230 and lower panel mounted bracket 232, as shown in FIGS. 6 and 7. The panel mounted brackets 230 and 232 may be attached to either or both adjacent modular wall panels 200*a* and 200*b*. Preferably, each panel mounted bracket is attached to only one of the modular wall panels, to facilitate assembly of the display system.

As set forth in FIG. 7, the panel mounted brackets 230 and 232 may be attached to a wall mounted bracket 234. The wall mounted bracket 234 is preferably affixed to a wall or other building structure (not shown), and is adapted to receive, securely but releasably, the panel mounted brackets 230 and 232 affixed tot he modular wall panel 200 as described above.

As set forth in FIG. 8, an alternative embodiment of the devices for mounting the panels 200 are possible. In this embodiment, an elongated panel mounted bracket 240 is attached to either or both modular wall panels 200*a* and 200*b*. In this embodiment, an upper wall mounted bracket 242 and a lower wall mounted bracket 244 are provided.

As set forth in FIG. 8, alternative means may be employed for attaching together the modular wall panels 200*a* and 200*b*. In this embodiment, brackets 246 are provided on each adjacent panel 200. The brackets 246 may be securely but releasably attached to one another by any conventional means, such as a threaded screw and nut assembly.

Figure 9:
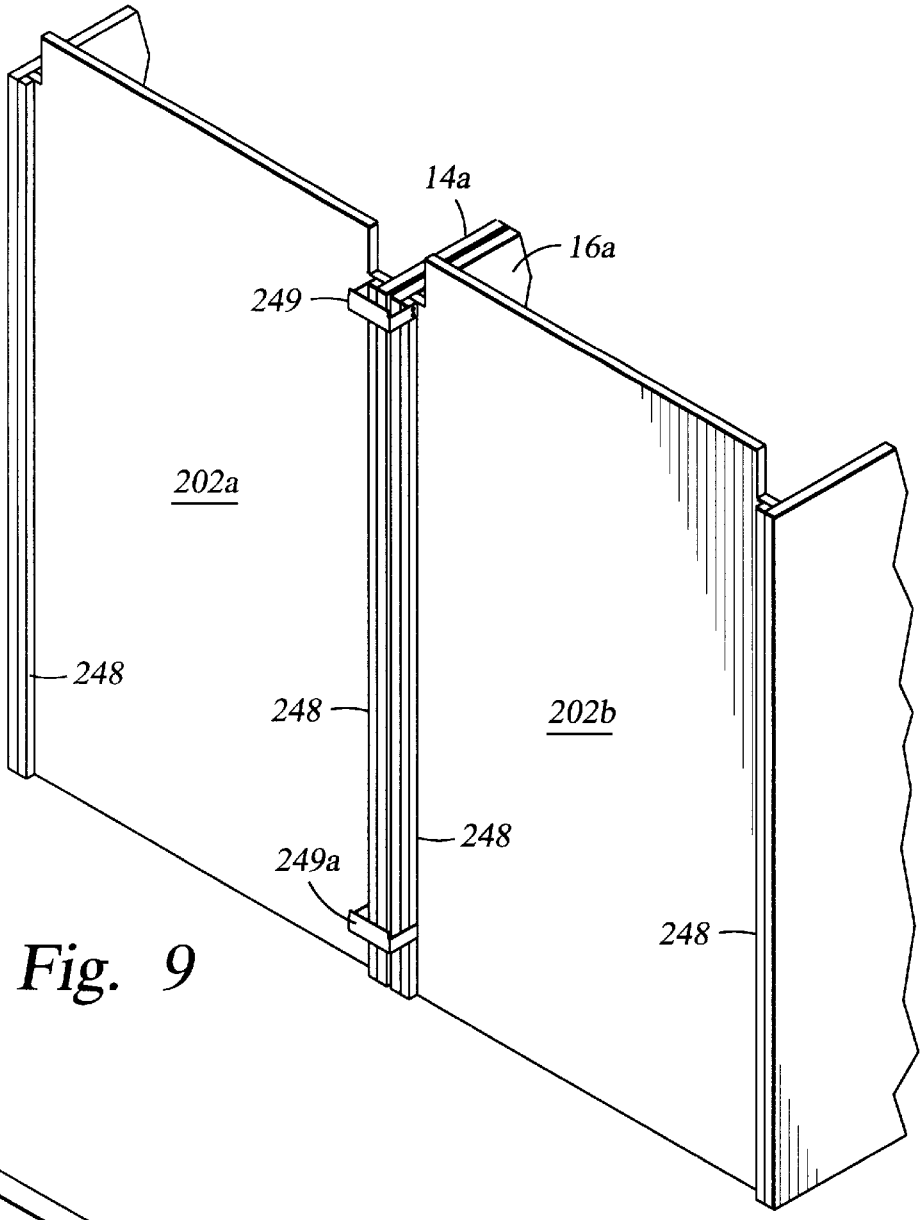
FIG. 9 is an angled rear view of a pair of modular wall panels, in which the panels serve as the back wall for the display unit, in accordance with the present invention.
Figure 9A:
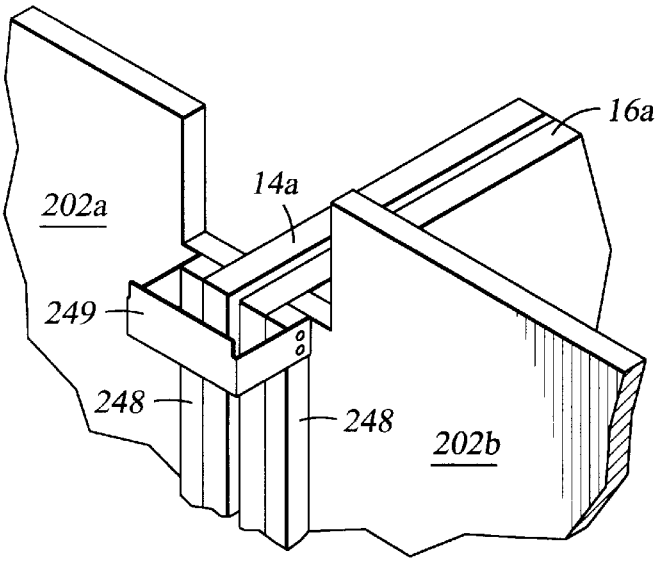

As set forth in FIG. 9, another embodiment of the devices for mounting the modular wall panels is available. In FIGS. 9 and 9A, slightly modified modular wall panels 202*a* and 202*b* are shown. In this embodiment, the panels 202*a* and 202*b* are each attached to a modified wing wall 14*a* and 16*a*, and to a mounting beam 248. The panels 202, the wing walls 14*a* and 16*a*, and the mounting beams 248 are interconnected by conventional means such as screws, glue or other means. The panels 202, the wing walls 14*a* and 16*a*, and the mounting beams 248 may be separately affixed as separate units. Such a unit comprises, e.g., the panel 202*a*, the wing wall 14*a* and one bracket 248. This unit may be permanently assembled. An analogous unit is formed by the panel 202*b*, the wing wall 16*a* and one bracket 248. Adjacent units thus assembled, may be both attached to each other and mounted to a wall or other building structure by a unit wall mounting bracket 249, as shown in FIGS. 9 and 9A. The unit wall mounting bracket 249 may have other forms such as lower unit mounting bracket 249*a*.

The foregoing devices for mounting and attaching together the modular wall panels are conventional, and equivalent devices may be substituted therefor without departing from the scope of the present invention.

The display unit of the invention may contain one or more non-retractable (stationary) racks either in addition to or in lieu of retractable rack 20. FIG. 1 illustrates shelving 34 for the mounting of a non-retractable decedent confinement chamber. Additional support for the chamber may be provided by extending shelving 34 the length of the interior of the alcove defined by back wall 12 and wing walls 14 and 16. Due to the torque imparted by the retractable rack in its extended position, it is best that the retractable rack be placed on the bottommost section of the display unit when a stationary rack is used in combination with a retractable rack.

An illuminating source may be concealed to the observer within the interior of the cornice design, preferably along the vertical beams of the cornice system. Exemplary of the illumination source are one or more track or pendant lights 70 which may easily be manipulated such that the light is directed onto selected merchandise within the display system. Track or pendant lights 70 are secured by conventional screws or nuts and bolts to the inside surface of vertical beams 62 and 64, as shown in FIG. 4.

Figure 4:
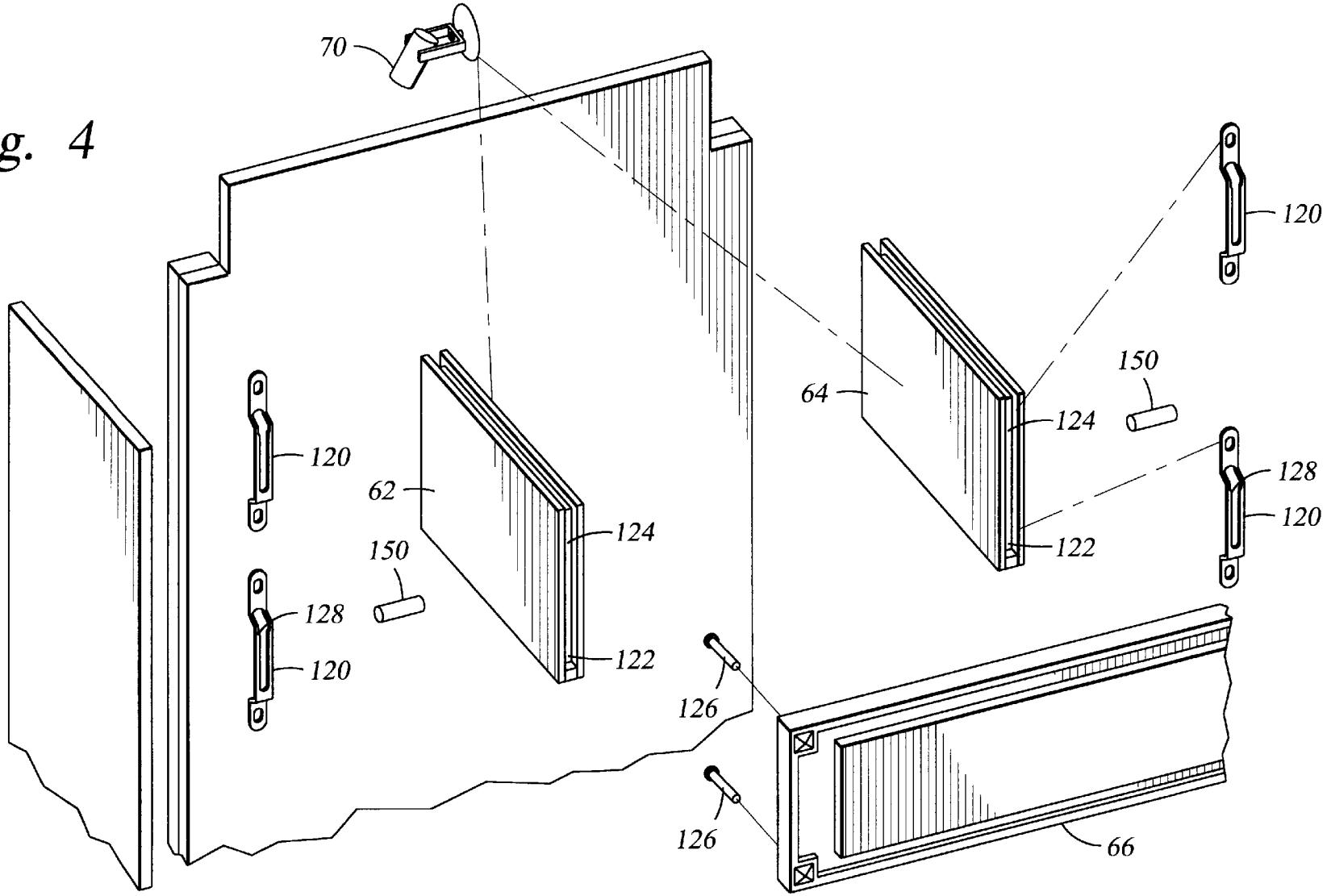
FIG. 4 is an exploded view of a display unit including a cornice assembly secured to the back wall.

The vertical beams 62 and 64 in FIG. 4 of a cornice assembly may be secured to the back wall of the display unit and the horizontal beam secured to the vertical beam by various known means, e.g., by a RTA fitting, by a threaded screw connection, by gravity lock method, or otherwise as known to those in the art. The preferred connecting member is the ready-to-assemble ("RTA") fitting 120, which includes a threaded fastener such as a machine-threaded screw extending longitudinally outward from the end of the receiving member and attached to a threaded nut or other threaded retaining device. For instance, the screw head of the RTA fitting may extend from the back wall of the connecting member. The receiving member is attached to the receiving end.

FIG. 4 demonstrates one method of securing the cornice assembly to back wall 12. Vertical beams 62 and 64 are secured to back wall 12 by threaded screws extending from the back of back wall panel 12 into the vertical beam. Mounting brackets are secured to the top 124 and bottom 122 of the front vertical beams 62 and 64. Mating screws are inserted into the back of horizontal beam 66 which interlock within the groove 128 of mounting bracket 120.

The configurations for use in the invention may further be characterized as a modular display system wherein modular units are prefabricated and are removably attached to one another to create the desired alcove configurations. In this manner, pieces of the display unit may be mixed or matched as well as be purchased concurrently with each other or at different times.

Figure 5:
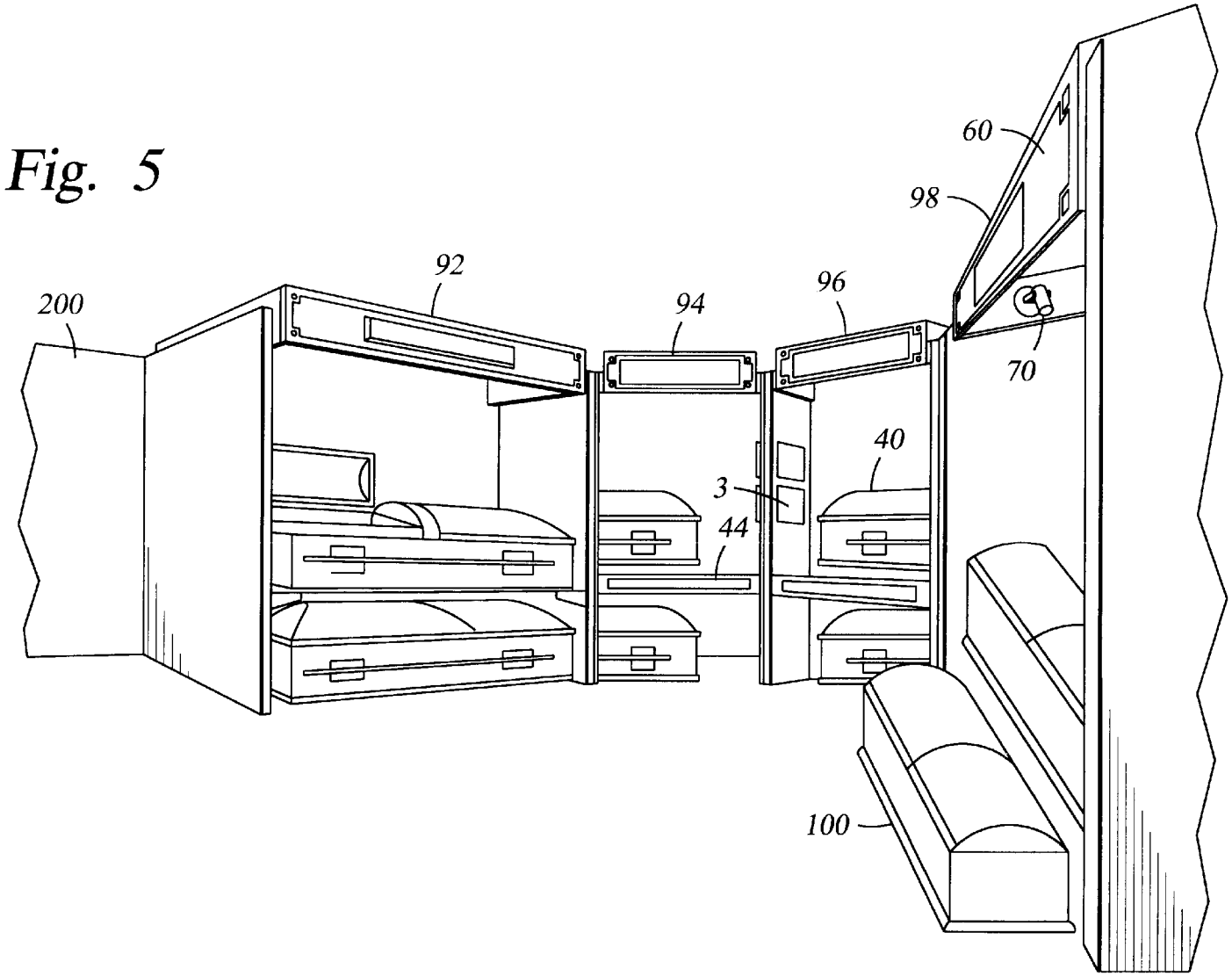
FIG. 5 is a frontal view of a death care merchandise display unit containing multiple alcoves, and partially showing a modular wall panel of the invention.

Some or all of the above embodiments of the invention may be configured to present multiple alcoves, principally for use in preview rooms. FIG. 5 depicts four alcoves 92, 94, 96 and 98. Alcoves 94 and 96 present sectional caskets (approximately one quarter size). Alcoves 92 and 98 present top and bottom full size caskets. The lower casket 100 in alcove 98 is on a retractable rack. Cornice 60 of alcove 98 contains track or pendant light 70.

The preferred embodiment of the death care merchandising system of the present invention includes at least one display unit 10 as described above, having two vertical, parallel, spaced wing wall panels 14 and 16, a vertical back wall 12 having lateral edges secured to the rear edges of the wing wall panels. In this system, the back wall 12 preferably supports the wing wall panels 14, 16, and maintains them in a vertical attitude. The preferred system further includes a retractable rack 18 for a decedent confinement chamber, as described above. The rack includes the front and rear horizontal beams 20*a*, 20*b*, in which the ends of the horizontal beams are connected by the vertical beam 22. The rack is preferably positioned between the two vertical spaced wing wall panels and is attached to the wing wall panels by means of a slide mechanism. The preferred embodiment further includes a plurality of modular wall panels 200, in which a first one of the panels is releasably attached to the display unit. Additional modular wall panels 200 may be appended to an end of the first one of the panels, to form a wall of any selected length. Additional modular wall panels 200 may be mounted perpendicular to the first modular wall panel, and so on, to form a full or partial enclosure. A second modular wall panel may be releasably attached to the side of the display unit opposite that to which the first modular wall panel is attached.

The plurality of modular wall panels may be arranged to define distinct and separate spaces so that one or more of the display units may be positioned separately from other of the display units. The purpose for such an arrangement is to provide a distinct and separate offering of death care merchandise for different purposes. For example, it may be desirable to offer burial-related merchandise separately from cremation-related merchandise. Likewise, it may be desirable to offer accessories and other paraphernalia in a location separated from the decedent confinement chambers. Furthermore, it is desirable to offer death care merchandise separately from rooms used for other death care functions, such as viewing rooms or memorial service rooms.

Figure 10A:
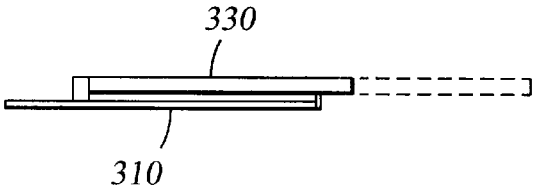
FIG. 10 is a side view of a pocket modular door panel, showing a passageway therethrough, in accordance with the present invention.
Figure 10:
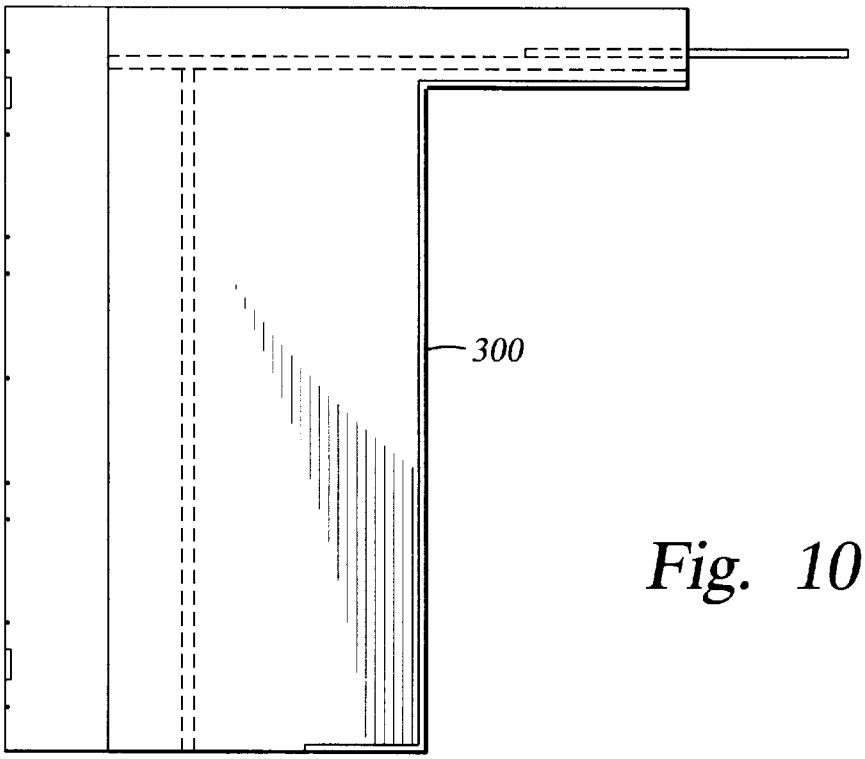
Figure 11:
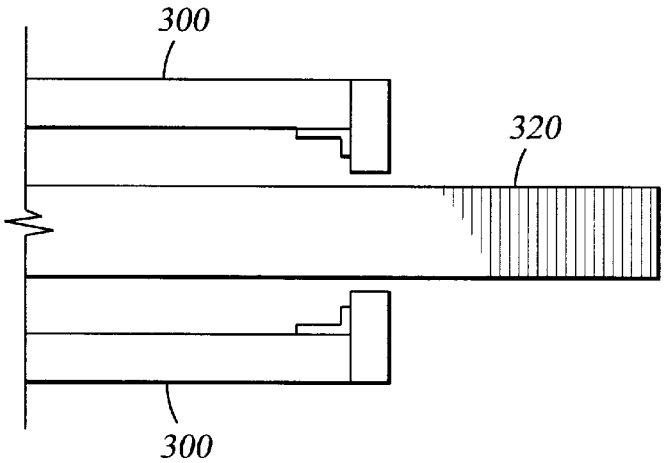
FIG. 11 is a cross-sectional view of a pocket modular door panel in accordance with the present invention.

As set forth in FIGS. 10 and 11, the system of the present invention may further include another type of modular wall panel referred to herein as a pocket modular door panel. Such a pocket modular door panel 300 preferably has a passageway through the panel and a door which is movable to open and close the passageway. The preferred pocket modular door panel 300 includes a pocket door 320 which may be withdrawn from the passageway into the wall panel 300 to which it is mounted. The preferred pocket door 320 is mounted on a U-shaped guide rail and is slidingly retractable from the passageways. Preferably the pocket door 320 retracts into the pocket modular door panel 300. In this embodiment, the door 320 is a conventional sliding panel or pocket door, having small wheels mounted so as to move in the track, thereby to allow the pocket door 320 to smoothly move back and forth. The pocket door 320 is thus movable from a generally concealed position within the pocket modular door panel to a position closing off the passageway between rooms or adjacent spaces. The preferred U-shaped guide rail for the door is similar to that described above for the slide mechanism for the rack 18.

Alternatively, as shown in FIG. 10A, the modular wall panel may include a door 330 which is mounted on one side of a side modular wall panel 310. In this embodiment, the side modular wall panel 310 includes a passageway therethrough, but does not include a double-layered panel 300 into which the door may be retracted. Rather, in this embodiment the door 330 is mounted adjacent to one side of the side modular wall panel 310. Preferably, as with the pocket door embodiment, in the side door embodiment, the door includes roller wheels for mounting and rolling in a U-shaped guide rail mounted on the side modular wall panel 310, as described above.

In both the pocket door and the side door embodiments, the doors and the mounting means are conventional, and various other conventional means may be substituted therefor without departing from the scope of the present invention.

Thus, the system may be constructed such that the plurality of modular wall panels, together with one of more of the pocket modular door panels, may be assembled so as to define a room separate from another room or space. The system thereby allows the user to provide separate rooms or spaces for showing the display units or other death care merchandise or for providing other death care services. Preferably at least one of the rooms encloses one or more display units.

The modular wall panels 200 may be free standing, separate from and not attached to or associated with any display unit. In such an embodiment the modular wall panels 200 are used to form a room or other separate space for use in death care otherwise than for displaying decedent confinement chambers.

As shown in FIG. 12, the death care merchandising system may be constructed so that a display unit is mounted in front of the modular wall panel or the pocket modular wall. Alternatively, the modular wall panel 200 may be substituted for and serve as the back wall of the display unit. Such an embodiment is shown in FIG. 9 as previously described.

As set forth in FIG. 5, the alcove 96 further contains signage 38, principally used for recording information about the merchandise within the alcove. The alcove 96 further contains retractable drawers 44, principally used for adornment merchandise. Wing wall panels adjoining two adjacent alcoves may share a common wall panel. Alternatively, the display may consist of distinct alcoves contiguous with each other. To give each of the units a more uniform look, dowel 150, as set forth in FIG. 4, may extend from the wing wall panel into the vertical beam of the cornice. Recessed receptors in the vertical beam and wing wall panel serve as the acceptor for the end of the dowel.

A finish on any or all of the surfaces of the merchandise display unit may be placed to more closely coordinate with the merchandise being displayed. For instance, where the merchandise display is of caskets or coffins, the back and wing walls of the display unit may be pigmented to enhance the colors of the merchandise.

Various modifications may be made in the nature, composition, operation and arrangement of the various elements, steps and procedures described herein without departing from the spirit and scope of the invention as defined in the following claims.

We claim:

1. A death care merchandise display unit comprising:

two vertical, parallel, spaced wing wall panels;

a vertical back wall having lateral edges secured to the rear edges of said wing wall panels, said back wall supporting said wing wall panels, and maintaining them in a vertical attutude;

a retractable rack for a decedent confinement chamber, comprised of a front and rear horizontal beam, the ends of the horizontal beams connected by a vertical beam, said rack being positioned between the two vertical spaced wing wall panels and attached thereto by means of a slide mechanism; and a modular wall panel adjacent to the back wall for the purpose of extending the death care merchandise display.

2. The death care merchandise display unit of claim 1, wherein the slide mechanism consists of one member attached to the inner side of the wing wall panel and a second member attached to the vertical beam of the rack.

3. The death care merchandise display unit of claim 1, further comprising a stationary rack or shelf located above the retractable rack.

4. The death care merchandise display unit of claim 1, further comprising at least one retractable drawer above said retractable rack for storage of adornment materials.

5. The death care merchandise display unit of claim 1, wherein said modular wall panel is releasably attached to said back wall.

6. The death care merchandise display unit of claim 1, wherein said modular wall panel is releasably attached to one of said wing walls.

7. The death care merchandise display unit of claim 3, further comprising at least one retractable drawer in close proximity to the stationary rack for storage of adornment materials.

8. A death care merchandise display unit comprising:

two vertical, parallel, spaced wing wall panels having vertical rear and front edges;

vertical back wall panel having lateral edges secured to said rear edges of said wing wall panels, said back wall means supporting said wing wall panels, and maintaining them in a vertical attutude;

a retractable rack positioned between the two vertical spaced wing wall panels, the retractable rack comprised of a front and rear horizontal beam, the ends of the horizontal beams connected by vertical beams, said rack being attached to the inner side of the wing wall panels by means of a slide mechanism;

a decedent confinement chamber placed on top of said retractable rack; and a modular wall panel adjacent to the vertical back wall panel for the purpose of extending the death care merchandise display.

9. The death care merchandise display unit of claim 8, wherein the slide mechanism consists of one member attached to the inner side of the wing wall panel and a second member attached to the vertical beam of the retractable rack.

10. The death care merchandise display unit of claim 8, further comprising a stationary rack above the retractable rack onto which is placed a second decedent confinement chamber.

11. The death care merchandise display unit of claim 8, wherein the decedent confinement chamber on said retractable rack is a casket.

12. The death care merchandise display unit of claim 10, wherein the second decedent confinement chamber is a casket.

13. The death care merchandise display unit of claim 10, wherein the decedent confinement chamber on said retractable rack and the second decedent confinement chamber are both caskets.

14. The death care merchandise display unit of claim 8, further comprising at least one retractable drawer above said decedent confinement chamber on said retractable rack for storage of adornment materials.

15. The death care merchandise display unit of claim 10, further comprising at least one retractable drawer in close proximity to the decedent confinement chamber on said stationary rack for storage of adornment materials.

16. The death care merchandise display unit of claim 8, further comprising at least one sectional decedent confinement chamber selected from the group consisting of caskets, burial vaults, and coffins attached to either the back wall or a wing wall panel.

17. The death care merchandise display unit of claim 16, wherein the sectional decedent confinement chamber is a casket.

18. The death care merchandise display unit of claim 16, wherein the sectional decedent confinement chamber extends from a wing wall panel at an angle greater than 90° relative to the wing wall panel.

19. The death care merchandise display unit of claim 17, wherein the sectional casket extends from a wing wall panel at an angle greater than 90° relative to the wing wall panel.

20. The death care merchandise display unit of claim 8, wherein said modular wall panel is releasably attached to said back wall.

21. The death care merchandise display unit of claim 8, wherein said modular wall panel is releasably attached to one of said wing walls.

22. A death care merchandise display unit comprising:

two vertical, parallel, spaced wing wall panels and a back wall having lateral edges secured to the rear edges of the wing wall panels, the back wall supporting said wing wall panels and maintaining them in a vertical attitude;

at least one decedent confinement chamber secured by its side surface onto the back wall and/or wing wall panel of the display unit, wherein the decedent confinement chamber is selected from caskets, coffins, burial vaults and sectionals or miniatures thereof; and a modular wall panel for the purpose of extending the death care merchandise display.

23. The death care merchandise display unit of claim 22, further comprising a second decedent confinement chamber positioned between the two vertical spaced wing wall panels and resting on top of a retractable rack and attached thereto by means of a slide mechanism wherein one member of the slide mechanism is attached to the inside of one wing wall panel and the other member is attached to the outside surface of the decedent confinement chamber.

24. The death care merchandise display unit of claim 23, wherein the retractable rack comprises a front and rear horizontal beam, the ends of the horizontal beam being connected by a vertical beam.

25. The death care merchandise display unit of claim 24, wherein the slide mechanism consists of one member attached to the inner side of the wing wall panel and a second member attached to the vertical beam of the rack.

26. The death care merchandise display unit of claim 22, further comprising at least one retractable drawer for storage of adornment materials.

27. The death care merchandise display unit of claim 23, further comprising at least one retractable drawer for storage of adornment materials.

28. The death care merchandise display unit of claim 22, further comprising a decorative wall panel mounted on at least one of the wing wall panels.

29. The death care merchandise display unit of claim 23, wherein the second decedent confinement chamber is a casket.

30. The death care merchandise display unit of claim 23, further comprising at least one retractable drawer above said second decedent confinement chamber for storage of adornment materials.

31. The death care merchandise display unit of claim 22, wherein the decedent confinement chamber is a sectional of a casket or burial vault.

32. The death care merchandise display unit of claim 23, wherein the decedent confinement chamber is a sectional of a casket.

33. The death care merchandise display unit of claim 32, wherein the second decedent confinement chamber is a casket.

34. The death care merchandise display unit of claim 22, wherein said modular wall panel is releasably attached to said back wall.

35. The death care merchandise display unit of claim 22, wherein said modular wall panel is releasably attached to one of said wing walls.

36. A death care merchandise display unit comprising:

two vertical, parallel, spaced wing wall panels having vertical rear and front edges;

vertical back wall having lateral edges removably secured to said rear edges of said wing wall panels, the back wall supporting said wing wall panels and maintaining them in a vertical direction;

at least one sectional decedent confinement chamber selected from the group consisting of caskets, coffins and burial vaults attached to at least one of the wing wall or back wall panels extending therefrom at an angle greater than 90° relative to the wall panel; and a modular wall panel adjacent to the vertical back wall for the purpose of extending the death care merchandise.

37. The death care merchandise display unit of claim 36, wherein the sectional decedent confinement chamber is a section of a casket.

38. The death care merchandise display unit of claim 36, further comprising a cornice.

39. The death care merchandise display unit of claim 36, further comprising at least one retractable drawer in close proximity to the sectional decedent confinement chamber for storage of adornment materials.

40. A death care merchandising system comprising:

at least one display unit having two vertical, parallel, spaced wing wall panels, a vertical back wall having lateral edges secured to the rear edges of said wing wall panels, said back wall supporting said wing wall panels, and maintaining them in a vertical attitude, a retractable rack for a decedent confinement chamber, comprised of a front and rear horizontal beam, the ends of the horizontal beams connected by a vertical beam, said rack being positioned between the two vertical spaced wing wall panels and attached thereto by means of a slide mechanism; and a plurality of modular wall panels, wherein at least one of said modular wall panels is releasably attached to said display unit for the purpose of extending the death care merchandise display.

41. The death care merchandising system of claim 40, wherein said plurality of modular wall panels are arranged to define a space separate from one or more of said at least one display units.

42. The death care merchandising system of claim 41, wherein said system further comprises a pocket modular door panel having a passageway therethrough and a door movable to open and close said passageway.

43. The death care merchandising system of claim 42, wherein said door is a pocket door.

44. The death care merchandising system of claim 42, wherein said door is mounted on a track and is slidingly retractable into said pocket modular door panel.

45. The death care merchandising system of claim 42, wherein said plurality of modular wall panels and at least one said pocket modular door panel together define a room separate from at least one said display unit.

46. The death care merchandising system of claim 45, wherein said room encloses at least one display unit.

47. The death care merchandising system of claim 45, wherein a portion of at least one said pocket modular door panel constitutes the back panel wall of at least one display unit.

48. The death care merchandising system of claim 46, wherein a portion of at least one said pocket modular door panel constitutes the back panel wall of at least one display unit.

* * * * *